US008348469B2

(12) United States Patent
Mrakovich et al.

(10) Patent No.: US 8,348,469 B2
(45) Date of Patent: Jan. 8, 2013

(54) FLEXIBLE HIGH-POWER LED LIGHTING SYSTEM

(75) Inventors: Matthew Mrakovich, Streetsboro, OH (US); Jeffrey Nall, Brecksville, OH (US)

(73) Assignee: GE Lighting Solutions LLC, Cleveland, OH (US)

( * ) Notice: Subject to any disclaimer, the term of this patent is extended or adjusted under 35 U.S.C. 154(b) by 1107 days.

(21) Appl. No.: 11/691,298

(22) Filed: Mar. 26, 2007

(65) Prior Publication Data

US 2007/0190845 A1 Aug. 16, 2007

Related U.S. Application Data

(63) Continuation of application No. 11/254,184, filed on Oct. 19, 2005, now Pat. No. 7,210,957, which is a continuation-in-part of application No. 10/819,328, filed on Apr. 6, 2004, now Pat. No. 7,429,186.

(51) Int. Cl.
*F21V 29/00* (2006.01)

(52) U.S. Cl. ..... 362/294

(58) Field of Classification Search ..... 439/460; 362/294, 231, 249, 373; 361/719
See application file for complete search history.

(56) References Cited

U.S. PATENT DOCUMENTS

| | | | |
|---|---|---|---|
| 671,338 | A | 4/1901 | Halford |
| 3,115,541 | A | 12/1963 | Hanner et al. |
| 4,173,035 | A | 10/1979 | Hoyt |
| 4,419,538 | A | 12/1983 | Hansell, III |
| 4,631,650 | A | 12/1986 | Ahroni |
| 4,638,117 | A | 1/1987 | Ney |
| 4,701,991 | A | 10/1987 | Scheffer, Sr. |
| 4,729,076 | A | 3/1988 | Masami et al. |
| 4,777,573 | A | 10/1988 | Liao |
| 4,779,177 | A | 10/1988 | Ahroni |
| 4,807,098 | A | 2/1989 | Ahroni |
| 4,813,883 | A | 3/1989 | Staley |
| 4,815,814 | A | 3/1989 | Ulijasz |
| 4,855,885 | A | 8/1989 | MacEachern et al. |
| 4,899,266 | A | 2/1990 | Ahroni |

(Continued)

FOREIGN PATENT DOCUMENTS

CH 673 349 A5 2/1990

(Continued)

OTHER PUBLICATIONS

U.S. Appl. No. 60/193,531, filed Mar. 31, 2000.

(Continued)

*Primary Examiner* — Alexander Gilman
(74) *Attorney, Agent, or Firm* — Fay Sharpe LLP

(57) ABSTRACT

A string light engine includes a flexible power cord, a heat sink, an IDC terminal, a PCB, and an LED. The flexible power cord includes an electrical wire and an insulating material for the wire. The heat sink attaches to the power cord. The IDC terminal is inserted through the insulating material and electrically communicates with the wire. The PCB is at least partially received in the heat sink. The PCB includes a first surface having circuitry and a second surface opposite the first surface. The circuitry is in electrical communication with the IDC terminal. The second surface is abutted against a surface of the heat sink so that heat is transferred from the LED into the heat sink. The LED mounts to the first surface of the PCB and is in electrical communication with the circuitry.

11 Claims, 11 Drawing Sheets

U.S. PATENT DOCUMENTS

| | | | | |
|---|---|---|---|---|
| 4,908,743 | A | 3/1990 | Miller | |
| 4,984,999 | A | 1/1991 | Leake | |
| 5,010,463 | A | 4/1991 | Ross | |
| 5,051,877 | A | 9/1991 | Liao | |
| 5,109,324 | A | 4/1992 | Ahroni | |
| 5,121,310 | A | 6/1992 | Ahroni | |
| 5,141,449 | A | 8/1992 | Tieszen | |
| 5,154,508 | A | 10/1992 | Ahroni | |
| 5,173,839 | A | 12/1992 | Metz, Jr. | |
| 5,238,424 | A | 8/1993 | Vindum | |
| 5,257,049 | A | 10/1993 | Van Peteghem | |
| 5,278,432 | A | 1/1994 | Ignatius et al. | |
| 5,330,368 | A | 7/1994 | Tsuruzono | |
| 5,337,225 | A | 8/1994 | Brookman | |
| 5,367,122 | A | 11/1994 | de Olano | |
| 5,526,250 | A | 6/1996 | Ting et al. | |
| 5,528,474 | A | 6/1996 | Roney et al. | |
| 5,559,681 | A | 9/1996 | Duarte | |
| 5,584,567 | A | 12/1996 | Rumpel | |
| 5,601,448 | A | 2/1997 | Poon | |
| 5,672,000 | A | 9/1997 | Lin | |
| 5,697,175 | A | 12/1997 | Schwartz | |
| 5,785,418 | A * | 7/1998 | Hochstein | 362/373 |
| 5,829,865 | A | 11/1998 | Ahroni | |
| 5,848,837 | A | 12/1998 | Gustafson | |
| 5,857,767 | A | 1/1999 | Hochstein | |
| 5,934,930 | A | 8/1999 | Camps et al. | |
| 5,967,823 | A | 10/1999 | Tsui | |
| 6,017,241 | A | 1/2000 | Komai | |
| 6,042,248 | A | 3/2000 | Hannah et al. | |
| 6,079,848 | A | 6/2000 | Ahroni | |
| 6,095,847 | A | 8/2000 | Lin | |
| 6,116,944 | A | 9/2000 | Tseng | |
| 6,167,740 | B1 | 1/2001 | Lipari et al. | |
| 6,249,267 | B1 | 6/2001 | Ishihara | |
| 6,261,119 | B1 | 7/2001 | Green | |
| 6,274,924 | B1 | 8/2001 | Carey et al. | |
| 6,283,612 | B1 | 9/2001 | Hunter | |
| 6,290,365 | B1 | 9/2001 | Schlesinger | |
| 6,302,552 | B1 | 10/2001 | Ross et al. | |
| 6,318,886 | B1 | 11/2001 | Stopa et al. | |
| 6,345,902 | B2 | 2/2002 | Ohkohdo et al. | |
| 6,367,952 | B1 | 4/2002 | Gibboney, Jr. | |
| 6,371,637 | B1 | 4/2002 | Atchinson et al. | |
| 6,383,013 | B1 | 5/2002 | Ghesla et al. | |
| 6,394,626 | B1 | 5/2002 | McColloch | |
| 6,412,971 | B1 | 7/2002 | Wojnarowski et al. | |
| 6,450,664 | B1 | 9/2002 | Kelly | |
| 6,478,450 | B1 | 11/2002 | Grajcar | |
| 6,505,956 | B1 | 1/2003 | Priddy et al. | |
| 6,517,218 | B2 | 2/2003 | Hochstein | |
| 6,558,021 | B2 | 5/2003 | Wu et al. | |
| 6,566,824 | B2 | 5/2003 | Panagotacos et al. | |
| 6,578,986 | B2 | 6/2003 | Swaris et al. | |
| 6,582,100 | B1 | 6/2003 | Hochstein et al. | |
| 6,598,988 | B1 | 7/2003 | Noll et al. | |
| 6,609,813 | B1 | 8/2003 | Showers et al. | |
| 6,660,935 | B2 | 12/2003 | Southard et al. | |
| 6,663,257 | B2 | 12/2003 | Galli | |
| 6,712,486 | B1 | 3/2004 | Popovich et al. | |
| 6,787,999 | B2 | 9/2004 | Stimac et al. | |
| 6,932,495 | B2 * | 8/2005 | Sloan et al. | 362/294 |
| 6,966,674 | B2 * | 11/2005 | Tsai | 362/294 |
| 6,999,318 | B2 * | 2/2006 | Newby | 361/719 |
| 7,218,041 | B2 * | 5/2007 | Isoda | 313/11 |
| 2003/0063463 | A1 | 4/2003 | Sloan et al. | |
| 2005/0030765 | A1 | 2/2005 | Southard et al. | |
| 2005/0207151 | A1 | 9/2005 | Aanegola et al. | |
| 2005/0227529 | A1 | 10/2005 | Mrakovich et al. | |

FOREIGN PATENT DOCUMENTS

| | | | |
|---|---|---|---|
| DE | 198 29 774 | A1 | 1/2000 |
| EP | 0 331 224 | A2 | 9/1989 |
| EP | 0 632 511 | A2 | 1/1995 |
| EP | 1 002 696 | A2 | 5/2000 |
| GB | 1 490 978 | | 11/1977 |
| GB | 2 334 376 | | 5/1999 |
| JP | 63-5580 | | 1/1988 |
| JP | 02 172771 | | 7/1990 |
| WO | WO 99/39319 | | 8/1999 |
| WO | WO 00/22698 | | 4/2000 |
| WO | WO 00/31463 | | 6/2000 |
| WO | WO 00/36336 | | 6/2000 |
| WO | WO 02/097770 | A2 | 12/2002 |

OTHER PUBLICATIONS

Internet Website http://www.chainlight.com "Chainlight".

Internet Website http://www.lektroninc.com/products/stencil Lecktron LED Lighting Technology, LED Channel Letter Stencil System.

High-Flux LED Blue, Green, and Cyan, Target/Preliminary Data, Mar. 16, 1999.

LumiLeds, Provisional Technical Data, Version 1.2 (Dec. 12, 2000) LumiLed Star.

LumiLeds, Provisional Technical Data, Version 3 D (Nov. 15, 2000) LumiLed Line.

LumiLeds, Technical Data, Luxeon™ Power Light Source.

Internet Website http://www.creativemag.com/cwo10100.html, Creative World Jan. 2000.

Internet Website http://www.smartlite.com/hiliter.html.

International Search Report dated Jul. 8, 2005 corresponding to International Application No. PCT/US2005/009870.

Written Opinion of International Searching Authority dated Jul. 8, 2005 corresponding to International Application No. PCT/US2005/009870.

International Search Report dated Dec. 13, 2007.

* cited by examiner

FLEXIBLE HIGH-POWER LED LIGHTING SYSTEM

This application is a continuation of U.S. patent application Ser. No. 11/254,184, filed Oct. 19, 2005, which is a continuation-in-part application of U.S. patent application Ser. No. 10/819,328, filed Apr. 6, 2004. The entirety of both applications are incorporated by reference herein.

BACKGROUND

Brief Description

Light emitting diodes (LEDs) are employed as a basic lighting structure in a variety of forms, such as outdoor signage and decorative lighting. LED-based light strings have been used in channel letter systems, architectural border tube applications, under cabinet lighting applications, and for general illumination, many times to replace conventional neon or fluorescent lighting.

Known attempts to provide a lighting system that can replace neon or fluorescent lighting includes mechanically affixing an LED light source to a flexible electrical cord. Other known systems mount LEDs on printed circuit boards that are connected to one another by electrical jumpers. These known high-power LED products require mounting to conductive surfaces to dissipate the heat generated from the LED and are susceptible to mechanical and electrical failures due to external forces or poor installation techniques. These known systems also have limited flexibility and have limited lineal resolution. Furthermore, some of these systems are not user serviceable to replace individual LEDs or LED modules.

Accordingly, it is desirable to provide an LED light engine that overcomes the aforementioned shortcomings.

SUMMARY

A string light engine includes a flexible power cord, a heat sink, an IDC terminal, a PCB, and an LED. The flexible power cord includes an electrical wire and an insulating material for the wire. The heat sink attaches to the power cord. The IDC terminal is inserted through the insulating material and electrically communicates with the wire. The PCB is at least partially received in the heat sink. The PCB includes a first surface having circuitry and a second surface opposite the first surface. The circuitry is in electrical communication with the IDC terminal. The second surface is abutted against a surface of the heat sink so that heat is transferred from the LED into the heat sink. The LED mounts to the first surface of the PCB and is in electrical communication with the circuitry.

A method of manufacturing a string light engine includes the following steps: inserting an IDC terminal into a flexible power cord; mechanically attaching the IDC terminal to an electrical connector disposed on a first surface of a PCB; and inserting the PCB into a heat sink. The electrical connector comprises at least one of an electrical receptacle and a male terminal and the IDC terminal provides electrical communication between the flexible power cord and an LED mounted on the first surface of the PCB.

A string light engine includes a flexible power cord and a plurality of LED modules attached to the power cord. The flexible power cord includes a first wire and second wire. Each module includes a thermally conductive PCB, an LED, a heat conductive first housing portion, an electrically insulative second housing portion, and an IDC terminal. The thermally conductive PCB has circuitry printed on a first surface. The LED mounts to the first surface of the PCB and is in electrical communication with the circuitry. The heat conductive first housing portion receives the PCB. The electrically insulative second housing portion connects to the first housing portion. The second housing portion retains the PCB against a surface of the first housing portion. The IDC terminal operatively connects to the PCB and is inserted into the insulating material of the power cord such that the LED is in electrical communication with the first wire via the IDC terminal.

DETAILED DESCRIPTION

Figure 1:
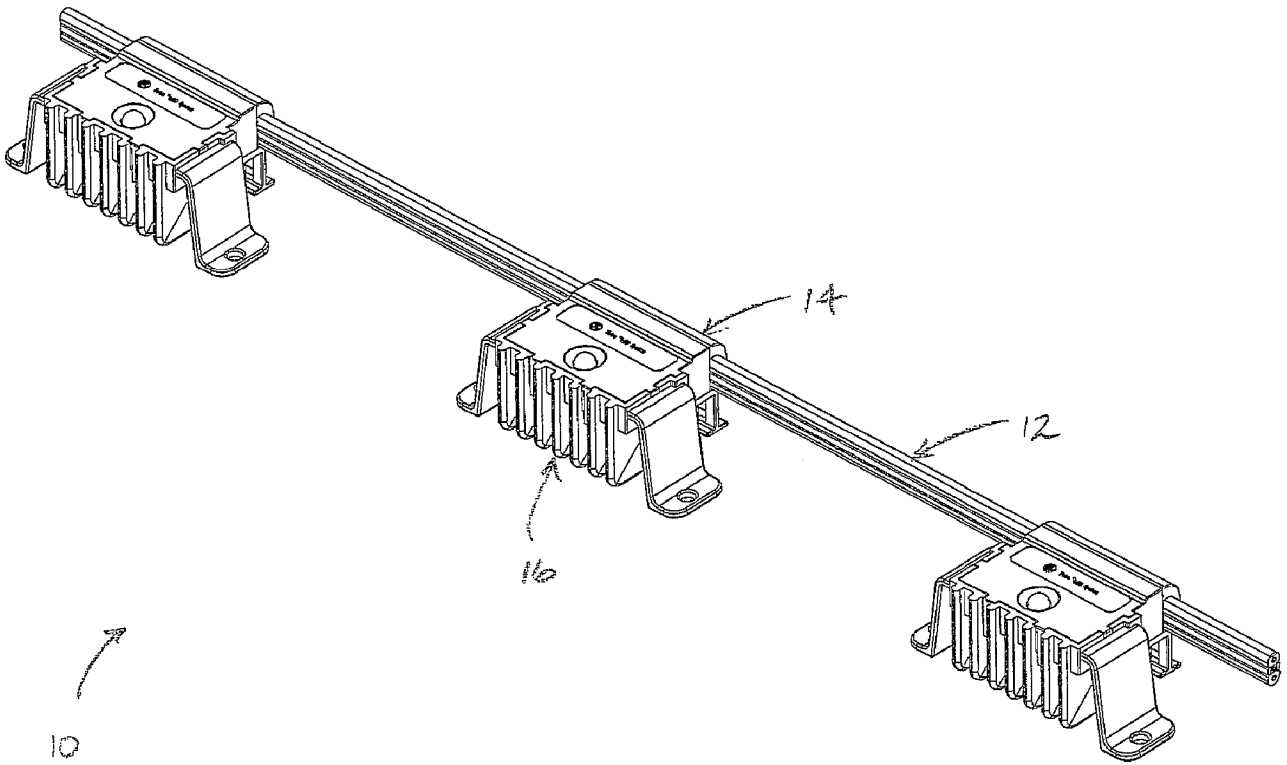
FIG. 1 is a perspective view of an LED light engine.
Figure 8:
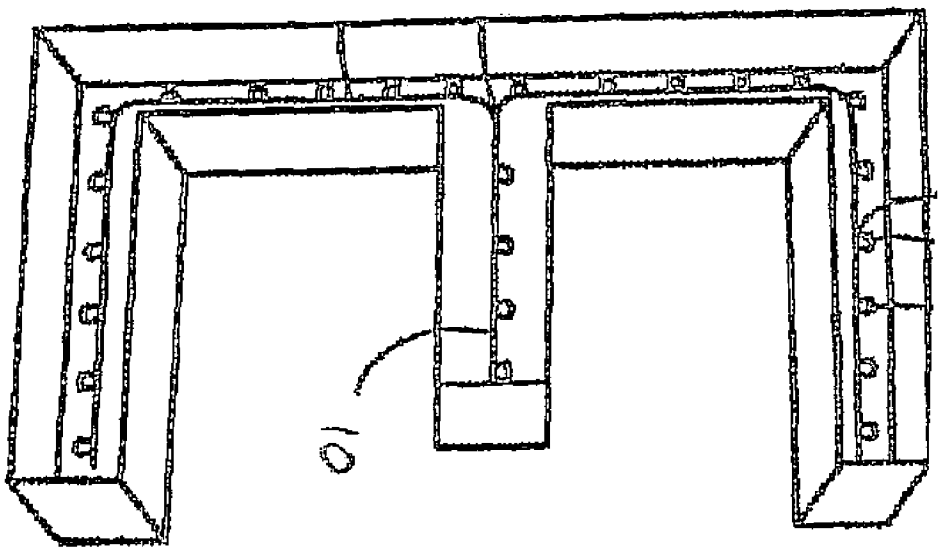
FIG. 8 illustrates the light engine of FIG. 1 disposed in a channel letter housing.

With reference to FIG. 1, a light emitting diode (LED) light engine 10 includes a flexible electrical cable 12, a wire-socket assembly 14 attached to the flexible electrical cable and an LED module 16 that selectively attaches to the wire-socket assembly. The light engine 10 can mount to a variety of different structures and can be used in a variety of different environments, some examples include channel letter and box sign illumination (FIG. 8), cove lighting, and under cabinet accent lighting to name a few.

Figure 2:
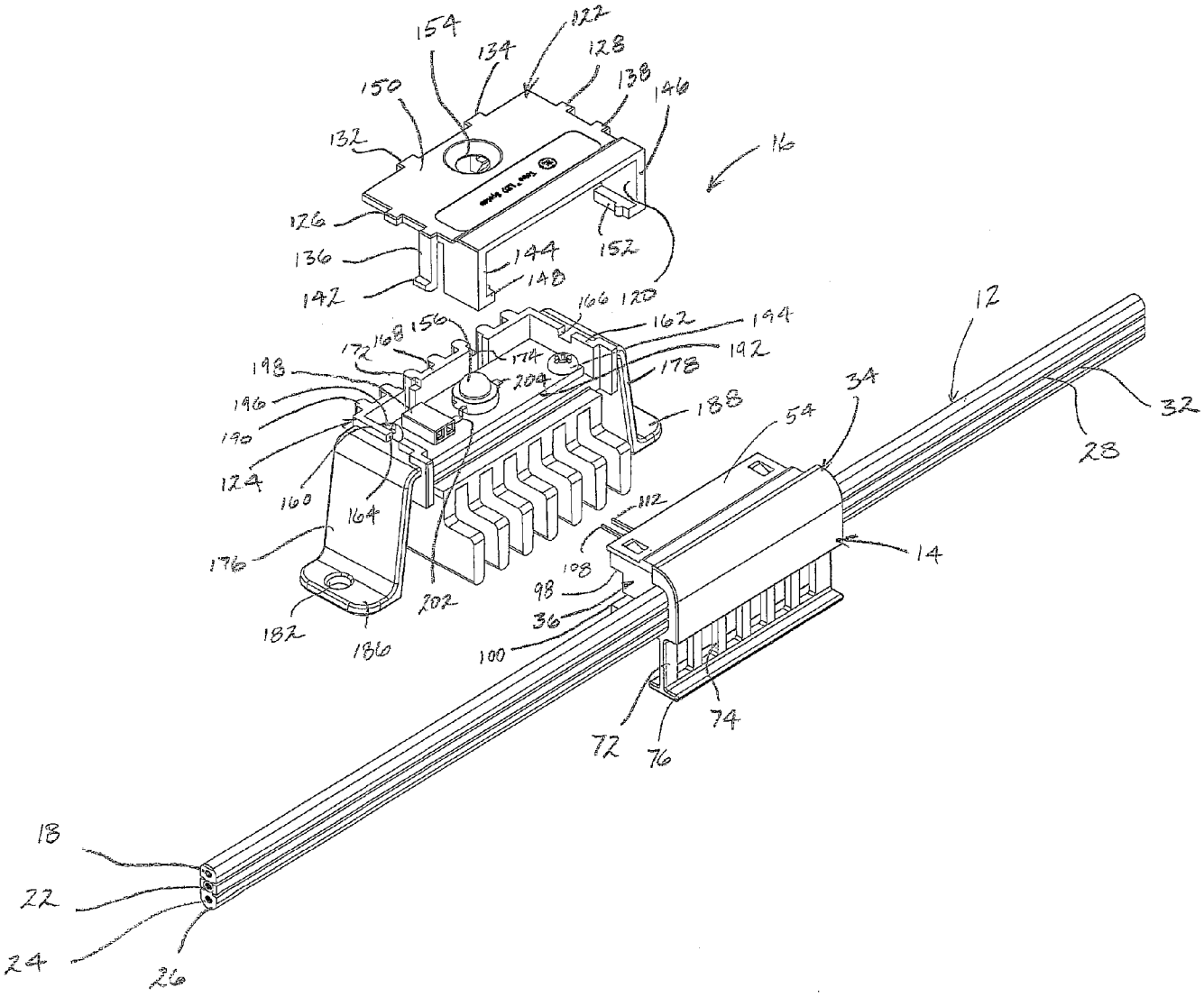
FIG. 2 is an exploded view of an LED module of the LED light engine of FIG. 1.

Referring to FIG. 2, the flexible electrical cable 12 includes a plurality of conductors 18, 22 and 24 surrounded by an insulating covering 26. Three conductors are depicted in the figures; however, the cable can include a several to many wires, where some of the wires may deliver power and some may deliver electronic signals or the like. Preferably, the conductors are 14 American wire gage (AWG) or 16 AWG; however, wire of other thickness can be used. With electricity running through the cable, the conductors can be referred to as a positive conductor 18, a negative conductor 24 and a series conductor 22. The conductors 18, 22, and 24 electrically connect to a power supply (not shown), which can include a low voltage output power supply, to provide voltage to the LED modules 16 for illumination. The conductors 18, 22, and 24 run parallel to a longitudinal axis of the cable 12 and are aligned with one another in a plane. Such an orientation allows the cable 12 to easily bend when placed on an edge that intersects the plane, e.g. the thinner edge of the cable in FIG. 2. The cable 12 also includes V-shaped grooves 28 and 32 formed in the insulating covering 26. The grooves 28 and 32 run longitudinally along the cable 12 parallel to the conductors 18, 22 and 24. The grooves 28 and 32 are situated between adjacent conductors 18, 22 and 24.

In alternative embodiments, power can be delivered to the LED modules 16 via other power supply systems. For example, the wire-socket assembly 14, which in this instance may be referred to as a mount or mounting assembly, can attach to a flexible circuit, e.g. copper traces on a flexible material, or a lead frame, e.g. an insulated lead frame formed from a stamped metal electrical bus. The flexible circuits and the lead frames can be connected to one another by wires, electrical jumpers or the like.

Figure 3:
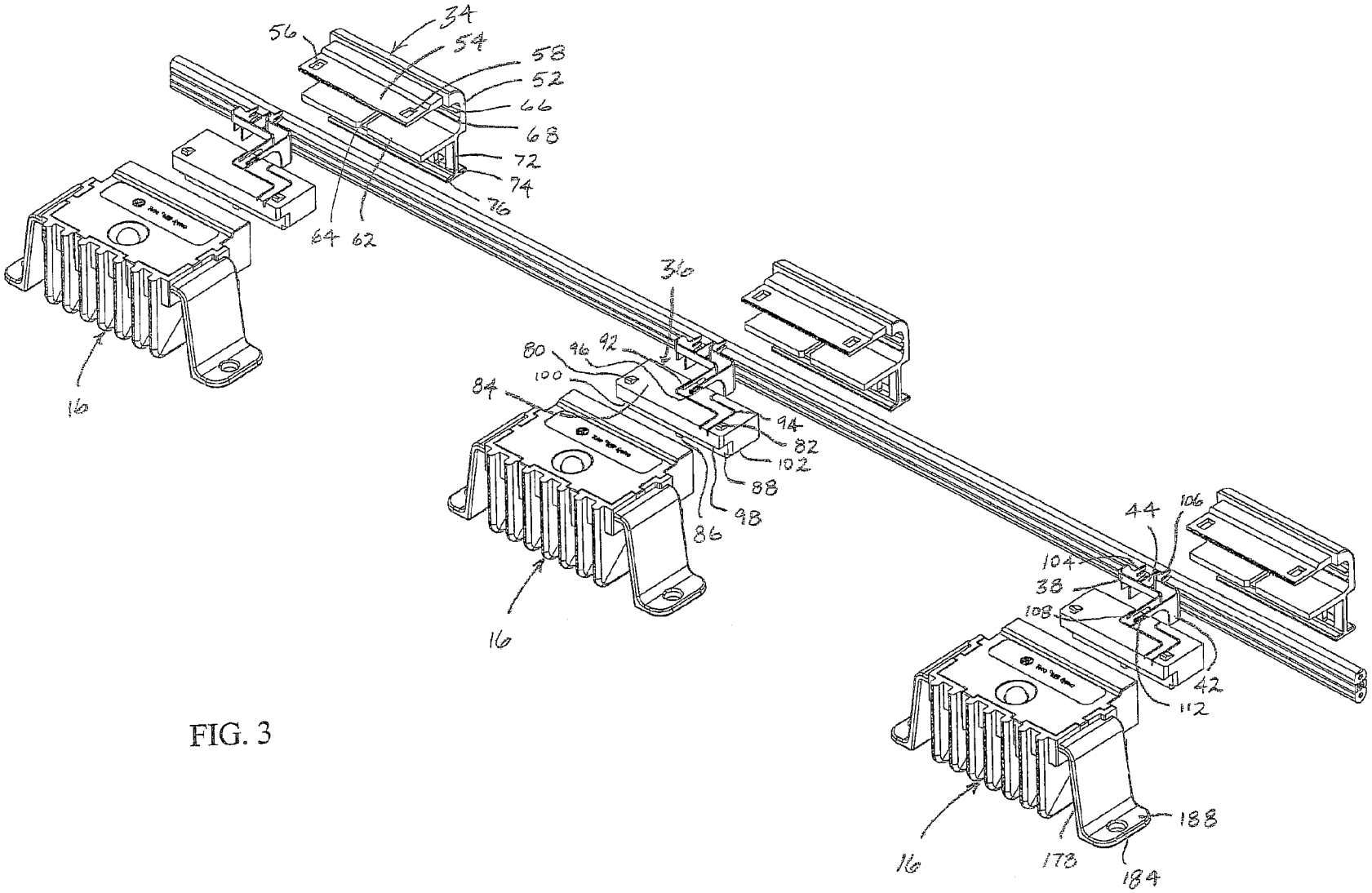
FIG. 3 is an exploded view of a wire-socket assembly of the LED light engine of FIG. 1.

As seen in FIG. 3, the wire-socket assembly 14 includes a cover 34, a base 36 and insulation displacement connection (IDC) terminals 38 and 42. The wire-socket assembly 14 allows LED module 16 to selectively attach to the electrical cable 12. Accordingly, the wire-socket assembly 14 can be referred to as a mount, a portion of a mount or a mounting assembly. In the embodiment depicted in the figures, the wire-socket assembly 14 plugs into the LED module 16, which allows for easy replacement of the LED module. In alternative embodiments, the LED module 16 can plug into the wire-socket assembly 14, or the LED module 16 can selectively attach to the wire-socket assembly 14 in other conventional manners. With these types of connections, replacement of one LED module 16 on the light engine 10 can be made without exposing the conductor wires 18, 22 and 24 of the electrical cable 12.

The cover 34 includes a generally backwards C-shaped portion 52 that fits around the electrical cable 12. An upper portion 54 of the cover 34 has a pair of openings 56 and 58 that are used when connecting the cover to the base 36. A lower portion 62 of the cover includes a slot 64. The lower portion 62 is parallel to and spaced from the upper portion 54 a distance equal to the height, measured in the plane of the conductors 18, 22 and 24, of the electrical cable 12. The cover 34 also includes longitudinal ridges 66 and 68 formed on an inner surface of the backwards C-shaped portion 52 between the upper portion 54 and the lower portion 62. The ridges 66 and 68 are received in the grooves 28 and 32 of the electrical cable 12. A pedestal 72 depends downwardly from the C-shaped portion 52. The pedestal 72 includes a plurality of elongated slots 74 spaced longitudinally along the pedestal. The pedestal 72 also includes a platform 76 below the slots 74. The platform 76 can rest on or against the surface to which the light engine 10 will be mounted.

The base 36 attaches to the cover 34 by fitting into the backwards C-shaped portion 52 between the upper portion 54 and the lower portion 62 sandwiching the cable 12 between the base and the cover. The base 36 includes two tabs 80 and 82 on an upper surface 84 that are received in the openings 56 and 58 in the upper portion 54 of the cover 34. The base 36 also includes a tongue 86 on a lower surface 88 that slides into the slot 64 in the lower portion 62 of the cover 34. Slots 92, 94 and 96 are formed in the upper surface 84 of the base 36. The slots 92 and 94 receive the IDC terminals 38 and 42. Slot 96 receives a conductor separator 44. When the cover 34 receives the base 36, the upper portion 54 covers the upper surface 84 of the base to cover the slots 92 and 94 and a majority of the IDC terminals 38 and 42. The base 36 further includes a lower longitudinal notch 98 formed along a Face of the base adjacent the LED module 16 and lower lateral notches 100 and 102 formed on opposite lateral sides of the base. The notches 98, 100 and 102 facilitate the plug-in connection friction fit between the wire-socket assembly 14 and the LED module 16. In addition to the mechanical connection described between the wire-socket assembly 14 and the cable 12, the wire-socket assembly 14 can be formed with the cable 12 or affixed to the cable in other manners.

The IDC terminals 38 and 42 pierce the insulating material 26 that surrounds the conductors 18, 22 and 24 to provide an electrical connection. The IDC terminals 38 and 42 each include fork-shaped prongs 104 and 106 that are sharp enough to pierce the insulating covering 26 having tines spaced apart so that the prongs do not cut the conductors 18, 22 and 24, but rather receive the conductors between the tines. The IDC terminals 38 and 42 also include male terminal pins 108 and 112 that extend from the base toward the LED module 16 when the terminals are received in the slots 92 and 94 on the upper surface 84 of the base 36. The IDC terminals 38 and 42 are substantially S-shaped and the first prong 104 is spaced from the second prong 106 along the longitudinal axis of the electrical cable 12. The conductor separator 44 is spaced between the prongs 104 and 106 so that if the LED modules 16 are to be connected in parallel/series configuration, the series conductor wire 22 is cut between the prongs. Specific terminals 38 and 42 have been described; however, other terminals instead of IDC terminals can be used to provide the electrical connection between the conductors and the LED module. Furthermore, the alternative terminals can electrically attach to the wires and/or power supply system via solder, wire jumper, crimp on terminals, or other electrical-mechanical connections.

Figure 4:
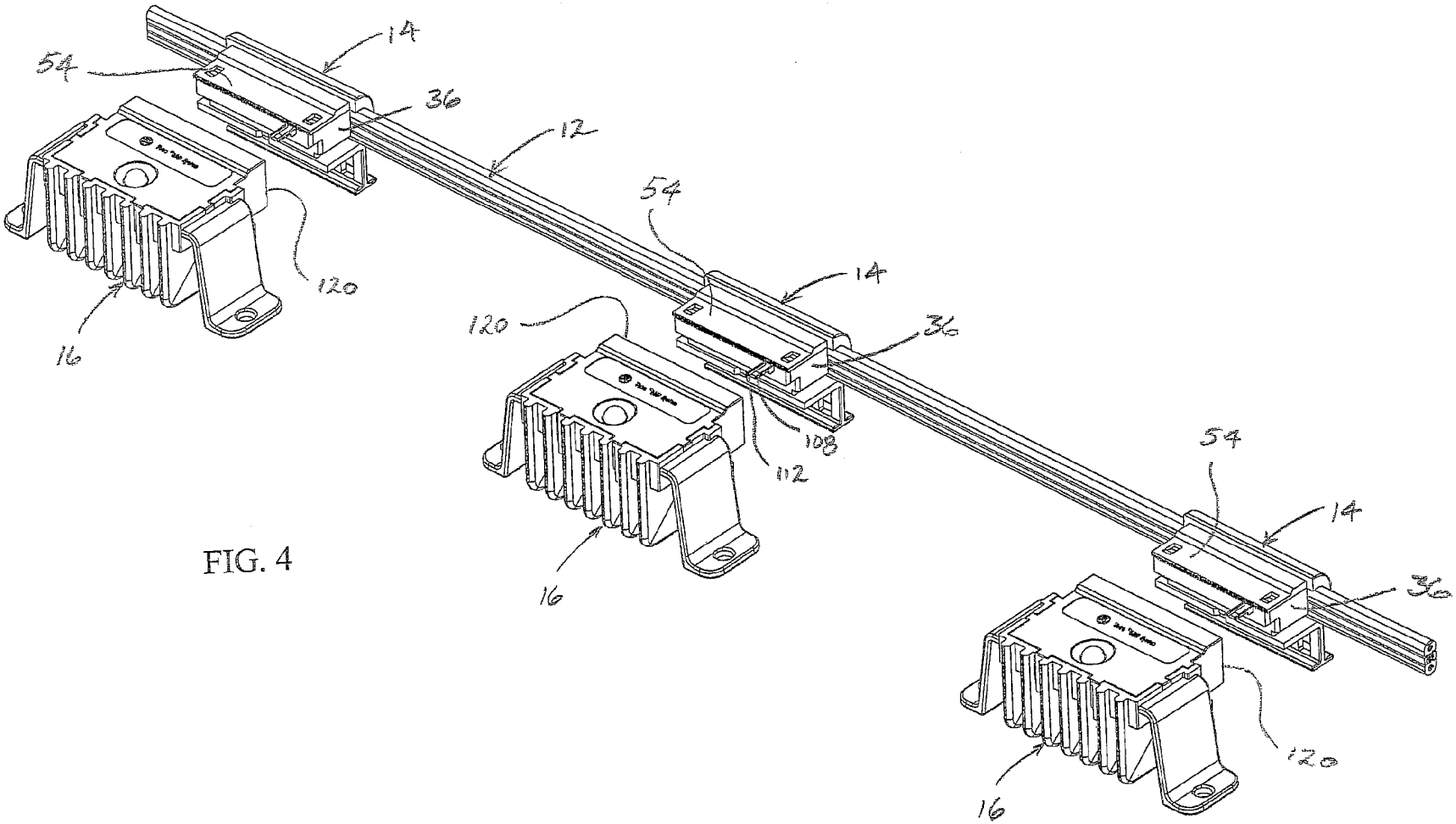
FIG. 4 is a view of the connection between the LED module and the wire-socket assembly of the LED light engine of FIG. 1.

With reference to FIG. 4, the wire-socket assembly 14 plugs into the LED module 16. The LED module 16 includes a mounting receptacle 120 into which the wire-socket assembly 14 fits. More specifically, the base 36 and the upper portion 54 of the cover 34 are received by receptacle 120. As mentioned above, in alternative embodiments the LED module 16 can plug into the wire-socket assembly 14, or the wire-socket assembly and the LED module can selectively attach to one another in other conventional manners.

With reference back to FIG. 2, the LED module 16 includes a cover 122 affixed to a base 124. The cover 122 includes two side tabs 126 and 128 on opposite sides of the cover and two rear tabs 132 and 134 on the rear of the cover. The cover 122 also includes two resilient clips 136 and 138 on opposite sides of the cover. The resilient clips 136 and 138 include knurls 142 (only one visible in FIG. 2). A pair of side walls 144 and 146 depend from opposite sides of the cover 122 in front (i.e., towards the wire-socket assembly 14) of both the respective side tabs 126 and 128 and the respective clips 136 and 138. Each side wall 144 and 146 includes a lower extension 148 and 152 that extend towards one another. The lower extensions 148 and 152 are spaced from an upper surface 150 of the cover 122 to define the mounting receptacle 120 of the LED module 16. The cover 122 also includes an opening 154 through which an LED 156 protrudes.

The cover 122 of the LED module 16 attaches to the base 124 of the LED module to cover the electrical connections leading to the LED 156. The base 124 includes side walls 160 and 162 that are opposite one another. Each side wall 160 and 162 includes a respective notch 164 and 166 that receives a respective side tab 126 and 128 on the cover 122. A rear wall 168 connects the side walls 160 and 162 and also includes notches 172 and 174 that receive rear tabs 132 and 134 of the cover 122. The side walls 160 and 162 make a right bend outward at the front of each side wall to accommodate the resilient clips 136 and 138. The clips 136 and 138 fit inside the side walls 160 and 162 and each knurl 142 catches on the bottom of each side wall to attach the cover 122 to the base 124.

Figure 7:
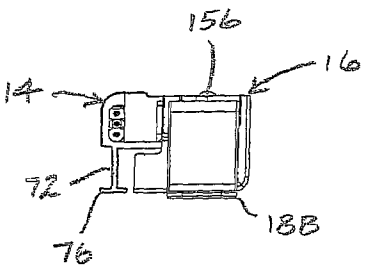
FIG. 7 an end elevation view of one LED module attached to one wire-socket assembly of the light engine of FIG. 1.
Figure 5:
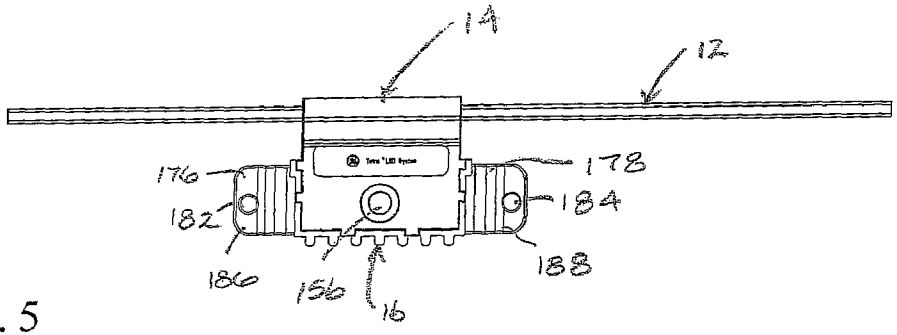
FIG. 5 is a plan view of one LED module attached to one wire-socket assembly of the light engine of FIG. 1.
Figure 6:
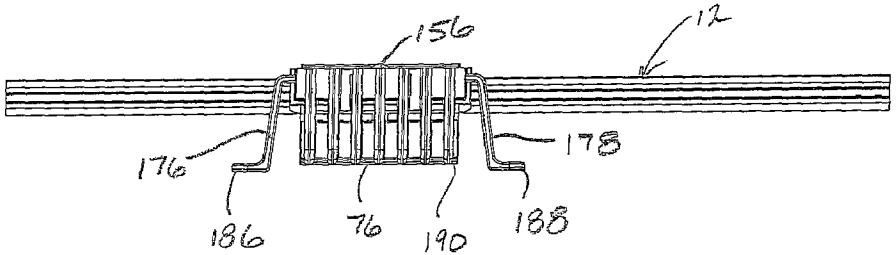
FIG. 6 is a side elevation view of one LED module attached to one wire-socket assembly of the LED light engine of FIG. 1.

Side connection tabs 176 and 178 extend from the side walls 160 and 162. The side connection tabs 176 and 178 include openings 182 and 184 (FIG. 3) in mounting surfaces 186 and 188 that can receive fasteners (not shown) to attach the LED module 16 to an associated surface, such as surfaces found in channel letter and box sign illumination, cove lighting, and cabinets. As seen in FIGS. 6 and 7, the mounting surfaces 186 and 188 are spaced from and below the platform 76. Referring to FIG. 1, the LED module 16 mounts in such a direction as compared to the electrical cable 12 to promote the greatest flexibility of the cable, i.e. the LED 156 faces a direction parallel to a plane that intersects the conductors 18, 22 and 24 of the cable 12.

Extending from the rear wall 168, a plurality of fins 190 can provide a heat sink for the LED 156. Fins are shown as the heat sink; however, the heat sink can also include pins or other structures to increase the surface area of the heat sink. The fins 190 extend rearward and downward from the rear wall 168. The fins 190 extend downward to almost the mounting surface 186 and 188 of each side connection tab 176 and 178, as seen in FIGS. 6 and 7, to maximize the surface area of the heat sink. As seen in FIG. 7, the fins 190 also extend towards the front, i.e. towards the cable 12, away from the upper portion of the base 124, again to maximize the surface area. With specific reference to FIG. 6, the fins 190 are aligned with the slots 74 in the pedestal 72 of the wire-socket assembly 14 so that air can flow through the slots 74 and between the fins 190 to cool the LED 156.

The LED 156 mounts to a support 192 that is received in the base 124 of the LED module 16. Preferably, the support 192 includes a thermally conductive material, e.g., thermal tape, a thermal pad, thermal grease or a smooth finish to allow heat generated by the LED 156 to travel towards the fins 190 where the heat can dissipate. The support 192 is affixed in the base 124 by fasteners 194 and 196; however, the support can affix to the base 124 in other conventional manners.

An electrical receptacle 198 mounts on the support 192 and receives male terminal pins 108 and 112 of the terminals 38 and 42 emanating from the wire-socket assembly 14. The electrical receptacle 198 electrically connects to leads 202 and 204 of the LED 156 via circuitry (not shown). The circuitry can be printed on the support 192, or wires can be provided to connect the receptacle to the leads 202 and 204. The circuitry can include voltage management circuitry.

In an alternative embodiment, an electrical receptacle similar to electrical receptacle 198 can mount to the wire-socket assembly 14. This electrical receptacle on the wire-socket assembly can receive male inserts that are electrically connected to the LED 156. Alternatively, selective electrical connection between the conductors 18, 22 and 24 and the LED 156 can be achieved in other conventional manners, including solder, wire jumper, crimp-on terminals, or other electromechanical connections.

As seen in FIG. 4, the LED module 16 receives the wire-socket assembly 14 to mount the LED module to the cable 12. Such a connection allows removal of the LED module 16 from the cable 12 without the holes formed by the IDC terminals 38 and 42 being exposed. With reference to FIG. 2, the base 36 and the upper portion 54 of the cover 34 are received between the lower extensions 148 and 152 and the upper surface 150 of the cover 122 such that the extensions 148 and 152 fit into the lower lateral notches 100 and 102 of the base 36 of the wire-socket assembly. The lower longitudinal notch 98 of the base 36 rest against the support 192 for the LED 156. The male terminal pins 108 and 112 are received by the electrical receptacle 198 to provide the electrical connection between the LED 156 and the conductors 18, 22 and 24. Accordingly, a friction fit exists between the LED module 16 and the wire-socket or mounting assembly 14 such that the LED module can be selectively removed from the cable 12 and the holes formed by the IDC terminals are not exposed. The plug-in connection between the LED module 16 and the mounting assembly 14 facilitates easy installation and LED replacement. Also, the heat sink provided on the LED module 16 allows the light engine 10 to dissipate heat without requiring the light engine to mount to a heat conductive surface.

Figure 9:
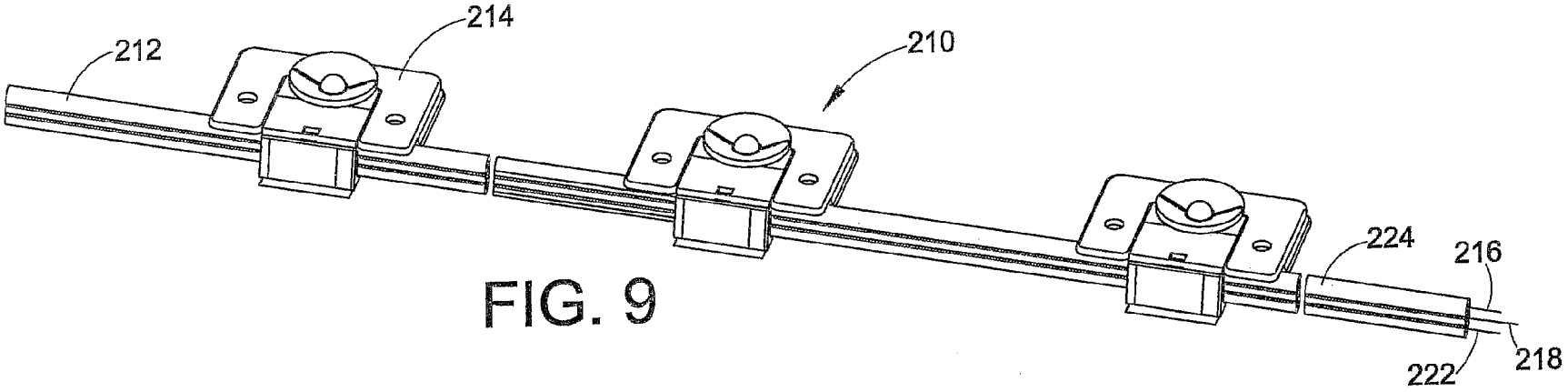
FIG. 9 is a perspective view of an alternative embodiment of a flexible LED light engine.

With reference to FIG. 9, an alternative embodiment of a light emitting diode (LED) light engine 210 includes a flexible power conductor 212, which can be similar to the flexible electrical cable 12 (FIG. 1), and a plurality of LED modules 214 attached to the flexible power conductor. The light engine 210 can mount to a variety of different structures and can be used in a variety of different environments, some examples include channel letter and box sign illumination, such as that depicted in FIG. 8, cove lighting and under-cabinet accent lighting.

The flexible power conductor 212 includes a plurality of wires, which in the depicted embodiment are positive (+) wire 216, negative (−) wire 218, and series wire 222. The power conductor also includes an insulative covering 224 that surrounds the wires 216, 218 and 222. The wires 216, 218 and 222 generally reside in a plane, which will be referred to as a bending plane. When the light engine 210 is mounted to a planar structure the bending plane in the depicted embodiment is generally perpendicular to the structure. Such an orientation allows the power conductor 212 to easily bend when placed on an edge that intersects the bending plane. The power conductor 212 can also include V-shaped grooves formed in the insulating covering 224 between adjacent wires. Power can be delivered to the LED modules via other power delivery systems such as a flexible circuit and/or a lead frame, which have been described above.

Figure 10:
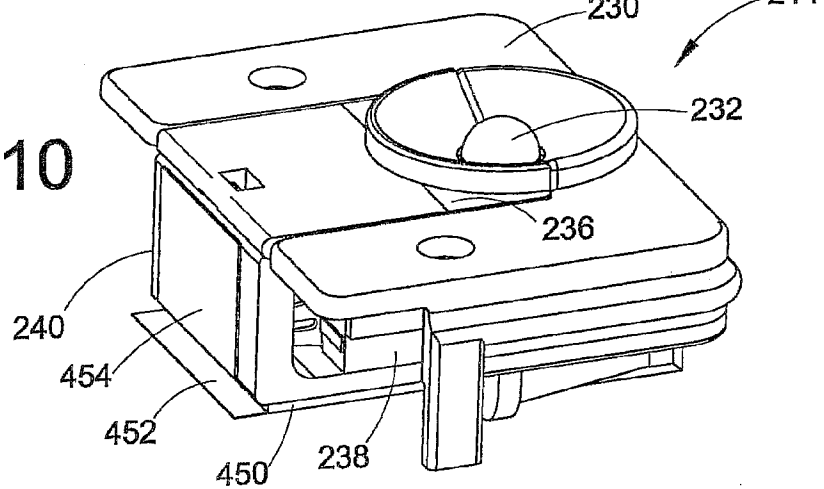
FIG. 10 is a perspective view of an LED module of the light engine depicted in FIG. 9.
Figure 11:
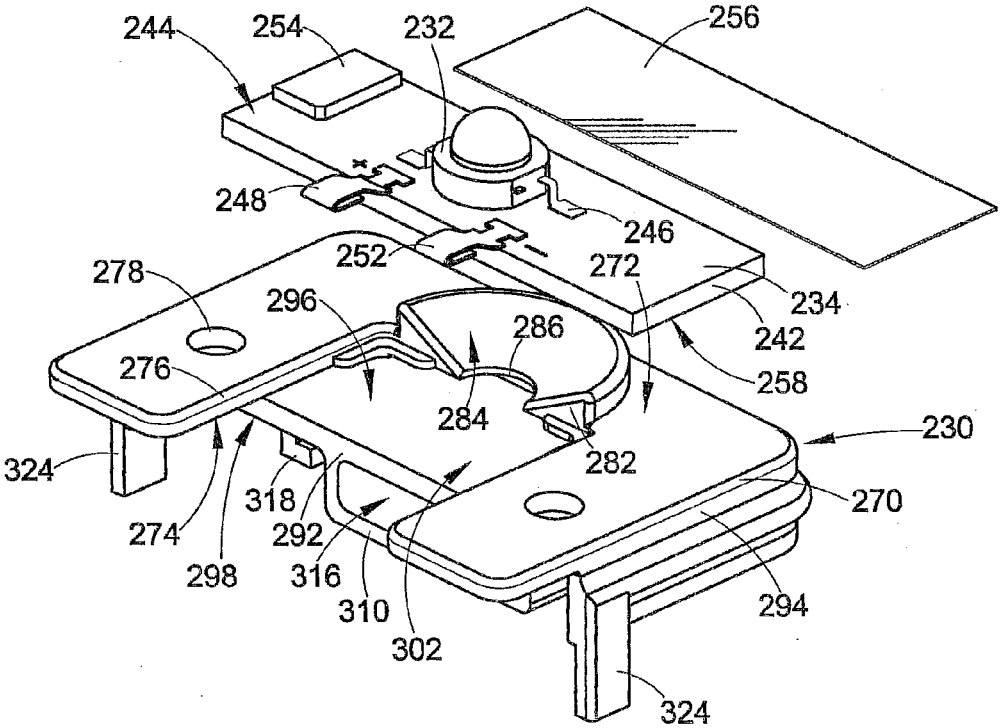
FIG. 11 is an exploded view of a portion of the LED module of FIG. 10.

With reference to FIG. 10, each LED module 214 generally includes a heat sink 230, an LED 232, a printed circuit board 234 (FIG. 11), a printed circuit board retainer 236, an IDC terminal holder 238, and a power conductor cover 240. With reference to FIG. 11, similar to the support 192 (FIG. 2), the printed circuit board 234 of the depicted embodiment generally includes a metal core 242 having a dielectric layer 244 disposed over the metal core. Accordingly, the PCB 234 in the depicted embodiment is a metal core printed circuit board (MCPCB); however, other PCBs and/or supports can be used. Circuitry (not shown) is formed on the dielectric surface 244 of the MCPCB 234. The LED 232 mounts on the dielectric surface 244. Contacts 246 extend from the LED 232 and provide an electrical connection between the printed circuitry and the LED. A positive male contact terminal 248 and a negative male contact terminal 252 each extend from a longitudinal edge of the PCB 234. The contact terminals 248 and 252 are in electrical communication with the circuitry printed on the PCB 234. The contact terminals 248 and 252 are soldered to the printed circuit board 234 and are bent over at a distal end. In the depicted embodiment, a resistor 254 is disposed on the dielectric surface 244 and is in electrical communication with the LED 232 via the circuitry printed on the PCB 234. The circuitry on the PCB can be different for different LED modules 214 that are attached to the conductor 212. For example, if the LED modules are connected to one another in a series/parallel configuration, the circuitry on the PCB can be changed accordingly. When the module 214 is assembled a thermal film 256 is disposed against a lower surface 258 of the PCB 234 to promote thermal transfer between the PCB and the heat sink 230.

The heat sink 230 is configured to receive and house at least a portion of the PCB 234. The heat sink 230 in the depicted embodiment made from heat conductive material, for example a zinc alloy. In the depicted embodiment, the heat sink 230 is formed, e.g. cast, as an integral unit that includes an upper portion 270 that defines a generally planar upper surface 272 and a generally planar lower surface 274. The upper portion 270 defines a generally U-shaped notch 276 that receives the PCB retainer 236 and the IDC terminal holder 238 (FIG. 10). Fastener openings 278 extend through the upper portion 270 of the heat sink 230. The fastener openings 278 receive fasteners, for example rivets, to allow for the attachment of the LED module 214 (FIG. 9) to an associated structure.

A truncated bowl-shaped portion 282 extends upwardly from the upper surface 272 of the upper portion 270. The truncated bowl-shaped portion 282 defines a truncated or partial frustoconical reflective surface 284 that tapers downwardly towards the LED 232 when the PCB 234 is received by the heat sink 230, as seen in FIG. 10. The partially bowl-shaped portion 282 and the reflective surface 284 has a segment removed about its axis of revolution to allow for receipt of the LED 232. The partially bowl-shaped portion 282 and the reflective surface 284 can take other configurations, for example the reflective surface can be parabolic and the surface need not be bisected as it is shown in the figures. The truncated bowl-shaped portion 282 in the upper portion 270 of the heat sink 230 extends over at least a portion of the upper surface 244 of the printed circuit board 234 when the printed circuit board is received by the heat sink. In the depicted embodiment, the truncated bowl-shaped portion 282 defines an opening, e.g. a semi-circular notch 286, that receives the LED 232 when the printed circuit board 234 is received by the heat sink 230.

The integral heat sink 230 also includes a central portion 292 that is spaced from the upper portion 270. The upper portion 270 and the central portion 292 are interconnected by a generally U-shaped side wall 294. The central portion 292 defines a generally planar upper surface 296 and a generally planar lower surface 298. The central portion 292 extends underneath the upper portion 270 and out into and below the notch 276 defined in the upper portion 270. The upper portion 270, the central portion 292, and the side wall 294 define a cavity 302 into which the PCB 234 is received. The thermal film 256 is disposed between the lower surface 258 of the printed circuit board 234 and the upper surface 296 of the central portion 292. Accordingly, heat is transferred from the printed circuit board 234 through the thermal film 256 into the central portion 292, where it can be spread into the side wall 294 and the upper portion 270 of the heat sink 230.

Figure 12:
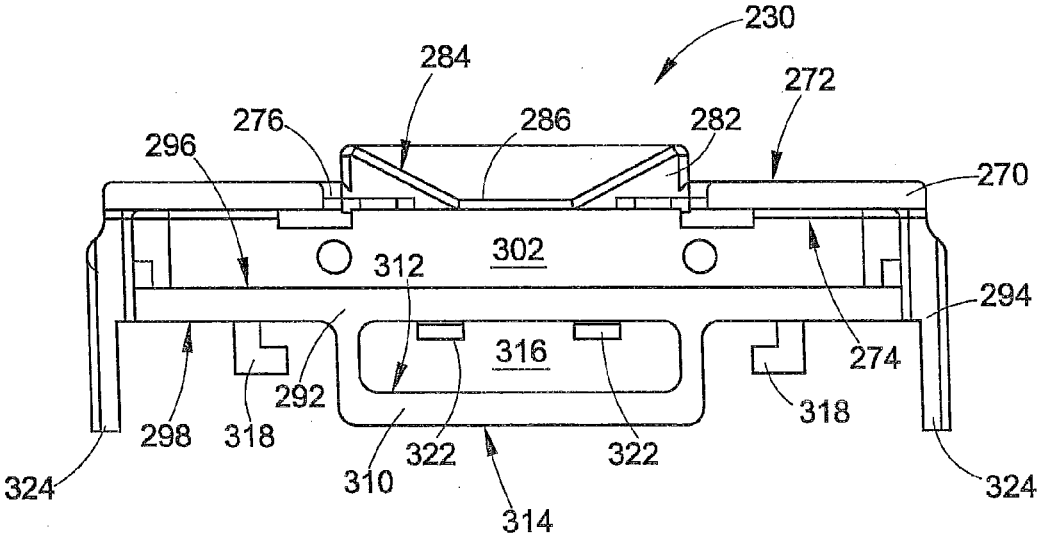
FIG. 12 is a front elevation view of a heat sink of the LED module of FIG. 10.

A generally U-shaped lower member 310 extends downwardly from the central member 292. The lower member defines a generally planar upper surface 312 and a generally planar lower surface 314. A lower cavity 316 is defined between the lower member 310 and the central member 292. L-shaped flanges 318 extend downwardly from the lower surface 298 of the central member 292 on opposite sides of the lower portion 310. Protrusions 322 also depend downwardly from the lower surface 298 of the central member 292. The protrusions 322 are disposed inside the cavity 316. Support posts 324 extend downwardly from forward edges of the side wall 294. As seen in FIG. 12, each support post 324 terminates in a plane that is coplanar with the lower surface 314 of the lower member 310. Accordingly, the support posts 324 and the lower surface 314 of the lower member 310 provide three points of contact for maintaining flatness of the heat sink 230 relative to the plane of the associated structure to which the light engine 210 (FIG. 9) is to be mounted. The support posts 324 are located adjacent the fastener openings 278 to provide stability to the heat sink 230 to prevent any deformation during riveting or screwing in of the fastener to the associated structure. The support posts 324 also separate the power cord 212 from any fastener that extends through the openings 278.

Figure 13:
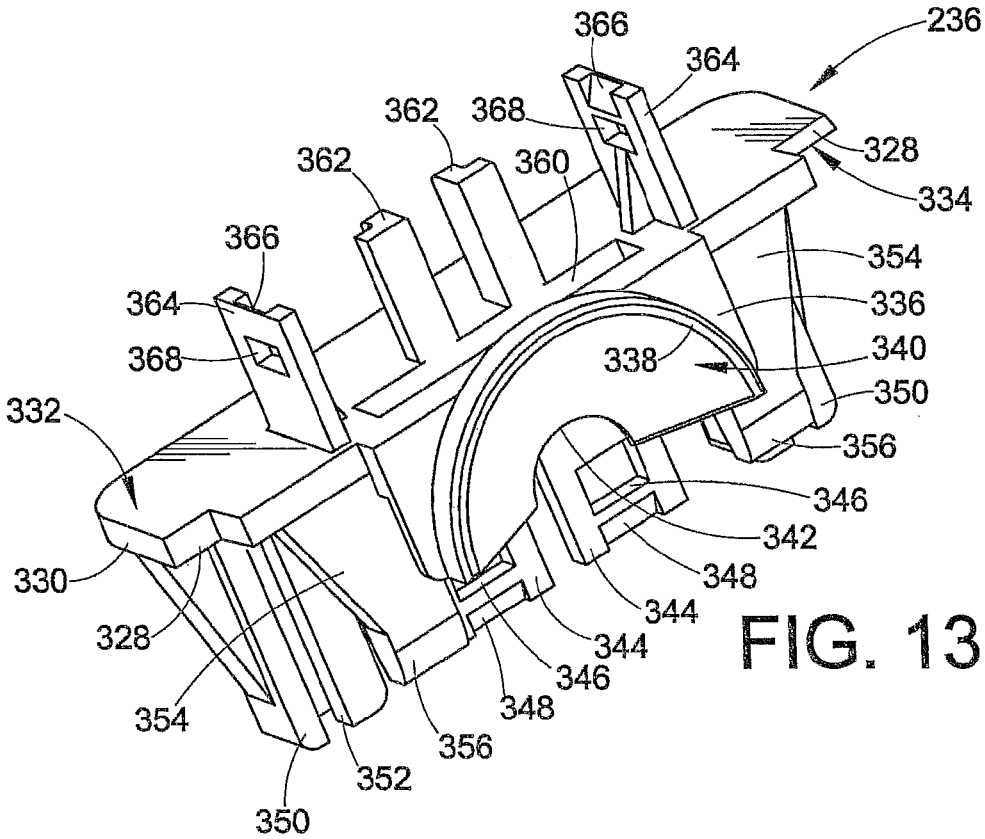
FIG. 13 is a first perspective view of a PCB retainer of the LED module of FIG. 10.

As seen in FIG. 10, the PCB retainer 236 attaches to the heat sink 230. With reference to FIG. 13, the PCB retainer 236 includes is an integrally formed member that, similar to the heat sink 230, can be formed, e.g. cast or molded, as one piece. In the depicted embodiment, the PCB retainer 236 is cast from hard plastic material. The PCB retainer 236 includes a base wall 330 having a first surface 332 and a second surface 334 that is opposite the first surface. Upper notches 328 are formed at opposite ends of the base wall 330, the usefulness of which will be described in more detail below. A plurality of members extend from these surfaces to connect to either the heat sink 230 or the cover 238. The PCB retainer 236 includes an upper cantilever portion 336 that extends from the second surface 334 of the base wall 330 towards the heat sink 230, when the PCB retainer 236 is attached to the heat sink. A truncated or partial bowl-shaped portion 338 extends upwardly from the cantilevered portion 336 and defines a partial frustoconical reflective surface 340. The truncated bowl-shaped portion 338 defines a semicircular notch 342 that receives the LED 232. When the PCB retainer 236 is fastened to the heat sink 230 the truncated bowl-shaped portion 338 of the PCB retainer 236 aligns with the truncated bowl-shaped portion 282 of the heat sink 230 to provide a reflective surface for the LED 232, where the combined reflective surfaces 284 and 340 forms a complete revolution about the LED 232.

Lower central prongs 344 extend from the second surface 334 of the base wall 330. Each lower central prong 344 includes an opening 346 and a ramped distal end 348. When the PCB retainer 236 is attached to the heat sink 230 the lower central prongs 344 are received inside the lower cavity 316 (FIG. 12) and the notches 344 receive the protrusion 322. The ramped distal ends 348 facilitate movement of each prong over the respective protrusion 322. Accordingly, the lower central prongs 344 are somewhat resilient to slide over the notches 322 (FIG. 12) of the heat sink 230.

Outer prongs 350 also extend from the second surface 334 of the base wall 330 of the PCB retainer 236 in the same general direction as the lower central prongs 344. The outer prongs 350 include L-shaped grooves 352. The L-shaped groove 352 receives the L-shaped prongs 318 (FIG. 12) that depend from the central portion 292 of the heat sink 230. The outer prongs 350 are received on opposite sides of the lower portion 310 (FIGS. 11 and 12) of the heat sink 230. Camming arms 354 also extend from the second surface 334 of the base wall 330 in the same general direction as the cantilevered portion 336. The camming arms 354 are disposed above the lower prongs 344 and 350. The camming arms include chamfered ends 356. The camming arms 356 contact the lower surface 274 (FIGS. 11 and 12) of the upper portion 270 of the heat sink 230 when the PCB retainer 236 is received inside the upper cavity 302 of the heat sink. The camming arms 356 are resilient and provide a downward force on the PCB 234 so that the PCB is pressed against the upper surface 296 of the central member 292 so that more contact is provided between the PCB 234 and the upper surface 296 to facilitate more thermal transfer between the two.

A slot 360 extends through the base wall 330 and receives the male terminals 248 and 252 (FIG. 11) that extend from the printed circuit board 234 when the PCB 234 and the PCB retainer 236 are received inside the cavity 302 of the heat sink 230. Central L-shaped fingers 362 extend rearwardly from the first surface 332 of the central wall 330 in a generally normal direction. The central fingers are disposed below the slot 360 formed in the base wall 330. Outer arms 364 also extend from the second surface 332 of the central wall 330. Each outer arm 364 includes a ramped distal end 366 and an opening 368.

Figure 15:
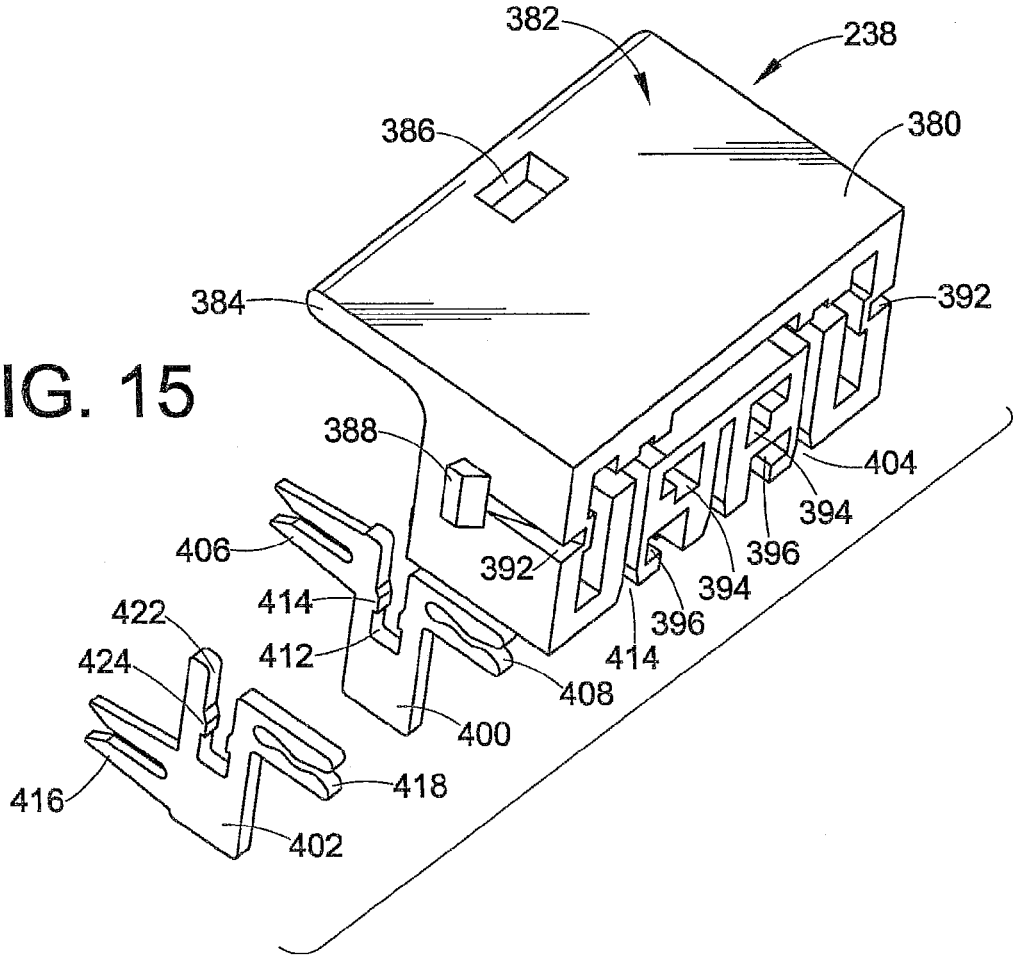
FIG. 15 is a perspective view of a terminal holder and terminals removed from the terminal holder for the LED module depicted in FIG. 10.

With reference to FIG. 15, the terminal holder 238 generally includes an integrally formed plastic body 380, e.g. cast or molded as one piece, having a planar upper surface 382. As more clearly seen in FIG. 16, the body 380 includes a cantilevered portion 384 that extends away from a remainder of the body. With reference back to FIG. 15, an opening 386 is formed through the cantilevered portion 384. The body 380 of the terminal holder also includes a plurality of slots that allows the terminal holder to attach to the heat sink 230 (FIG. 10) via the PCB retainer 236 (FIG. 10) and also to the cover 238 (FIG. 10). Tabs 388 (only one is visible in the figures) extend from opposite planar lateral surfaces of the body 380. Slots 392 are formed in the body 380 and extend from the tabs 388 towards and terminate at a forward surface, which is opposite the cantilevered portion. The tabs 388 are ramped downwardly toward the notches 392. With reference to FIG. 13, the outer arms 364 that extend from the first surface 332 of base wall 330 of the PCB retainer 236 cooperate with the tabs 338 to attach the PCB retainer 236 to the terminal holder 238. The ramped ends 366 of the outer arms ride over the ramped tabs 388 until the tab 388 is received inside the opening 368 of the arms 364. In the depicted embodiment, the arms include a web that is received inside the notches 392. With reference back to FIG. 15, the body 380 of the terminal holder 238 also includes centrally disposed L-shaped channels 394. These L-shaped channels 394 receive the arms 362 (FIG. 13) that extend from the first surface 332 of the base wall 330 of the PCB retainer 236. The body 380 of the terminal holder 238 also includes lower central L-shaped notches 396 to facilitate attachment between the terminal holder 238 and the cover 240.

The terminal holder 238 receives insulation displacement conductor ("IDC") terminals, which in the depicted embodiment are a first or high terminal 400 and a second or low terminal 402. The IDC terminals 400 and 402 are made from an electrically conductive material, e.g., metal. The first terminal 400 is received in a slot 404 that extends upwardly from a bottom surface of the body 380 towards the upper surface 382. The slot 404 is open at the bottom surface and is disposed between the central L-shaped channel 394 and a side lateral wall of the body. The channel 404 is substantially U-shaped. The first IDS terminal 400 includes a first forked portion 406 having pointed ends that are inserted through the insulating material 224 (FIG. 9) of the power conductor 212 to provide an electrical connection between one of the wires 216, 218 or 222 of the power conductor 212 to the LED 232. Opposite the first forked portion 406, the first IDC terminal 400 also includes a second rounded forked portion 408 that is configured to receive the male positive terminal 248 (FIG. 11) that extends from the printed circuit board 234 when the terminal holder 238 is attached to the heat sink 230 via the PCB retainer 236. The bent over portion of the male positive terminal 248 is compressed slightly in the second forked area of the first IDC terminal 400 to provide a more robust electrical connection between the male terminal 248, and thus the printed circuit board 234, and the IDC terminal 400. The first IDC terminal 400 also includes a U-shaped channel 412 that is interposed between the first forked pointed portion 406 and the second forked portion 408. Protrusions 414 extend inwardly into the U-shaped channel 412. These protrusions 414 provide a resilient fit so that the first IDC terminal 408 is snugly held inside the U-shaped channel 404 formed in the body 380 of the terminal holder 238.

Figure 16:
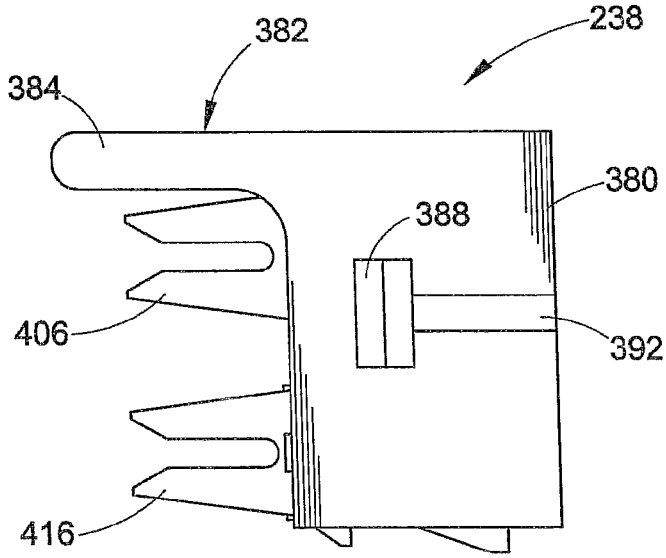
FIG. 16 is a side elevation view of the terminal holder and accompanying terminals disposed in the terminal holder of FIG. 15.

A second U-shaped notch 414 is also formed in the body 380 of the terminal holder 238 to receive the second IDC terminal 402. The second IDC terminal is referred to as a low terminal in that a first pointed forked portion 416 is disposed below the first forked end 406 of the first IDC terminal 400. The first forked end 416 is inserted into the insulating material 224 (FIG. 9) of the power conductor 212 to connect to one of the wires 216, 218 or 222. A second forked end 418 of the low IDC terminal 402 receives the negative male conductor 252 that extends from the printed circuit board 234 in a similar manner as that described with reference to the first IDC terminal 400. The second IDC terminal 402 also includes a U-shaped channel 422 and a bump or protrusion 424 that is similar to the U-shaped channel 412 and bump 414 of the first IDC terminal 400. As seen in FIG. 16, the pointed end 406 and 416 of the respective IDC terminals 400 and 402 are vertically spaced from one another so that they contact separate wires of the power conductor 212 (FIG. 9). The location of the pointed forked ends of the IDC terminals is dependant upon the location of the LED module 214 along the power conductor 212 and whether the LED module is to be connected in parallel, series, or a series/parallel configuration. Accordingly, the location of the pointed ends 406 and 416, i.e. the ends that extend into the power conductor 212 can change. Furthermore, a barrier member (not shown) can extend from the body 380 of the terminal holder 238 to interrupt the series wire 222, if desirable, so that the LED assemblies 214 can be wired in a series/parallel configuration.

Figure 17:
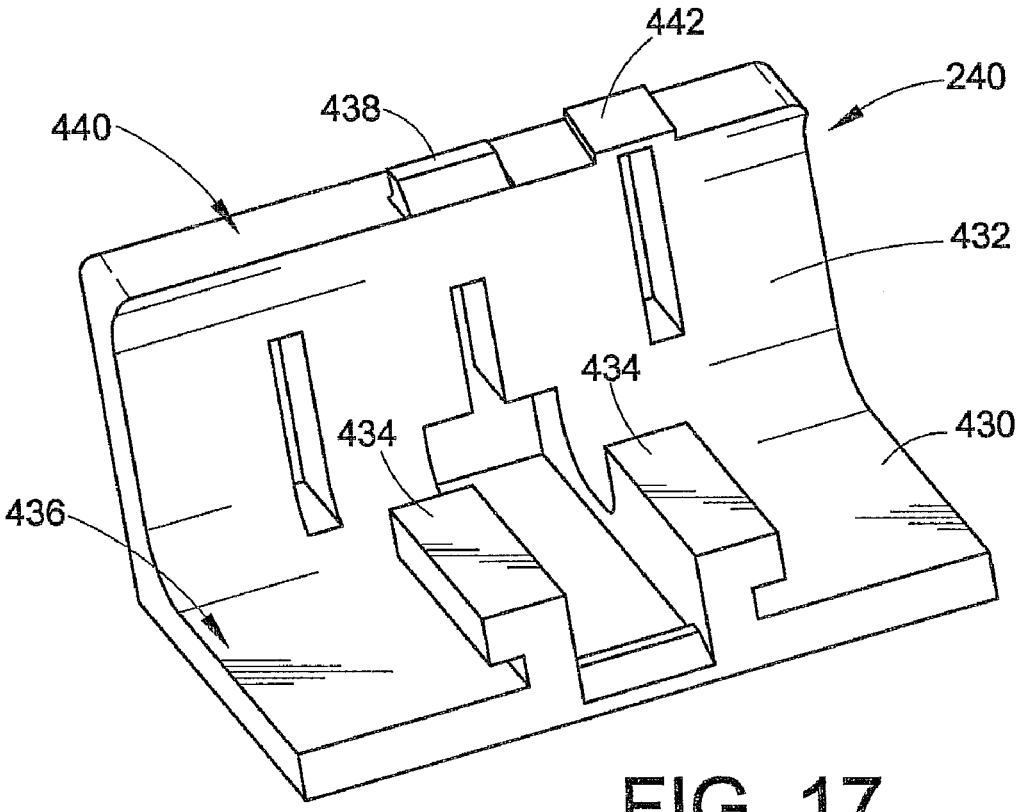
FIG. 17 is a perspective view of a cover of the LED module of FIG. 10.
Figure 18:
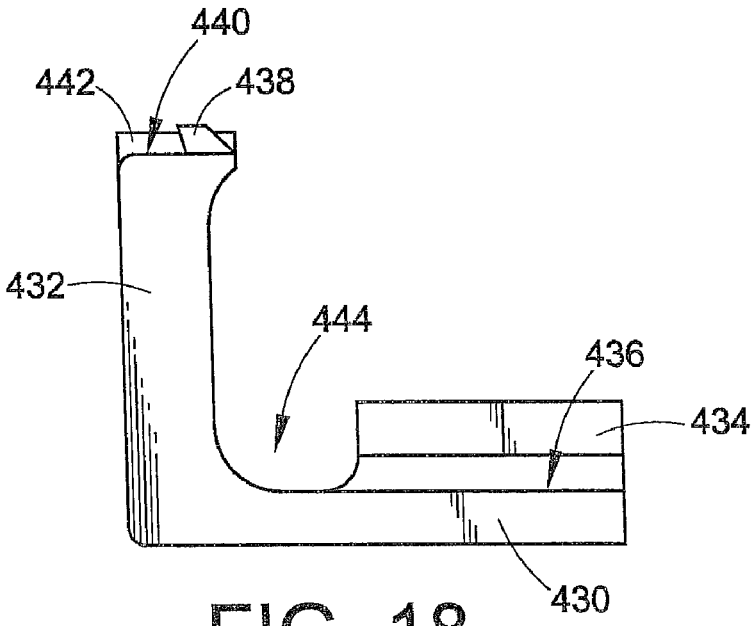
FIG. 18 is an end elevation view of the cover shown in FIG. 17.

With reference to FIG. 17, the cover 240 includes an integral plastic body, e.g. cast or molded as one piece, having an L-shaped configuration that includes a lower portion 430 and an upper portion 432 that is at a general right angle to the lower portion. A pair of L-shaped flanges 434 extend upwardly from an upper surface 436 of the lower portion 430. The upper surface 436 is generally planar. The L-shaped flanges 434 are received inside the lower central L-shaped notches 396 formed in the body 380 of the terminal holder 238 (FIG. 15). A ramp-shaped protuberance 438 extends from an upper end surface 440 of the upper portion 432. The ramp-shaped protuberance 438 is received inside the opening 386 in the cantilevered portion 384 of the terminal holder 238. The ramp-shaped protuberance 438 is ramped downwardly to facilitate movement of the protuberance in the opening 386. A block shaped protuberance 442 also extends from the upper surface 440. The block shaped protuberance 440 is received in a slot (not visible) in the cantilevered portion 384 of the terminal holder 238. As more clearly seen in FIG. 18, the cover 240 defines a power conductor mounting seat 444 generally at the intersection of the lower portion 430 and the upper portion 432. The mounting seat 444 is shaped and configured such that when the power conductor 212 is seated the wires 216, 218 and 222 of the power conductor 212 lie in a generally vertical plane, which defines the bending plane of the power conductor 212.

Figure 14:
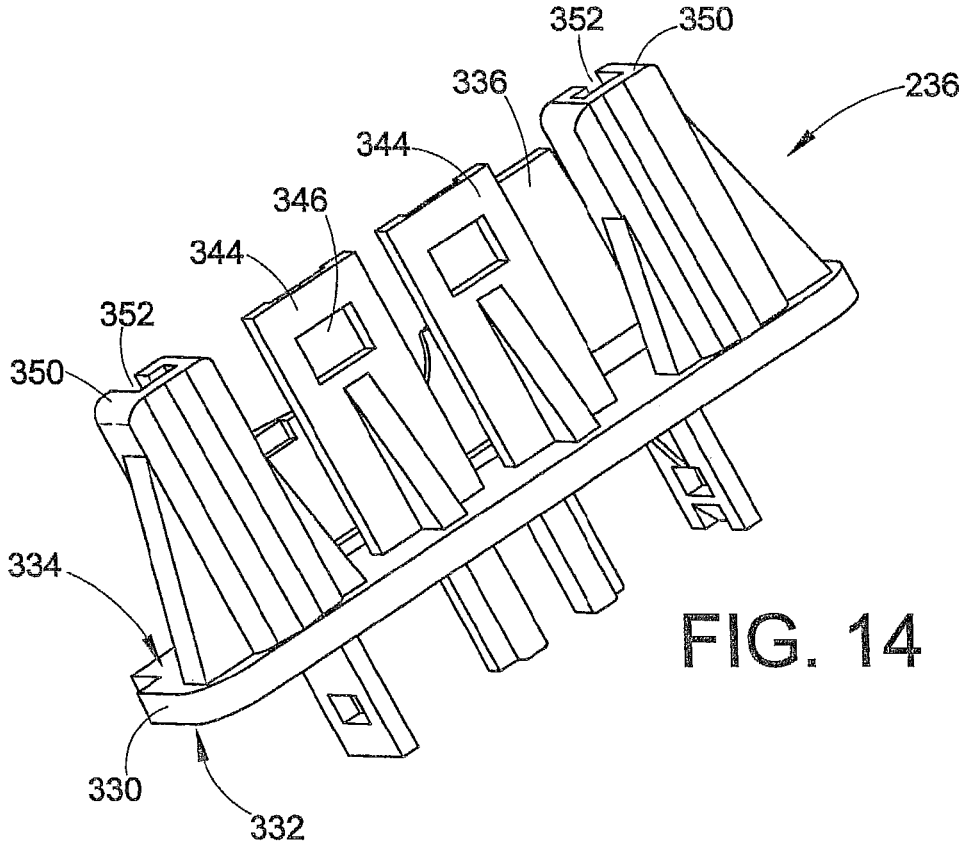
FIG. 14 is a second perspective view, opposite the first perspective view, of the PCB retainer shown in FIG. 13.

To assemble the light engine 210, as seen in FIG. 11, the printed circuit board 234 is inserted into the cavity 302 of the heat sink 230 and the thermal film 256 is interposed between the PCB 234 and the upper surface 296 of the central portion 292 of the heat sink. The PCB retainer 236 (FIGS. 13 and 14) is then connected to the heat sink 230 such that the camming arms 354 press down on the upper surface 244 of the PCB 234 to provide more thermal contact between the PCB 234 and the heat sink 230. No additional fasteners, e.g. screws, are required to retain the PCB 234. The PCB is then potted inside the cavity 302 of the heat sink 230 using a potting material that is known in the art. The potting material is introduced into the cavity via the notches 328 formed in the base wall 330 and the opening 360 in the base wall of the PCB retainer. The potting material is thermally conductive to provide thermal path that further improves thermal performance of the heat sink 230 and also provides environmental protection for the components mounted on the PCB 234. Accordingly, heat is transferred via the upper surface 244 through the potting material and into the upper portion of the heat sink and via the lower surface 258 of the PCB 234 through the thermal tape 256. The terminal holder 238, having the IDC terminals, for example first terminal 400 and second terminal 402 disposed therein, is attached to the PCB retainer 236. The cover 240 (FIG. 17) then sandwiches the power conductor 212 (FIG. 9) between the upper portion 432 of the cover 240 and the body 380 of the terminal holder 238 thus forcing the forked regions 406 and 416 of the terminals 400 and 402 through the insulation material 224 of the power conductor 212 to provide for an electrical connection between the wires of the power conductor and the LED 232. As seen in the embodiment depicted in FIG. 10, a double sided adhesive tape 450 is applied to a lower surface of the cover 240. A release layer 452 covers an adhesive layer of the tape 450. Also, a module tag 454 attaches to the cover 240. The module tag 240 can include indicia to identify the circuitry printed on the PCB 234.

The assembly of the LED module 214 does not require fasteners. Also, the components of the LED module 214 that house the PCB 234 are modular. Accordingly, the heat sink 230 can be replaced where it is desirable to provide more heat dissipation.

To mount the string light engine 210, the adhesive layer 452 is removed and stuck to a desired surface. The LED module 214 is then attached using fasteners that are received through the openings 278 (FIG. 11) formed in the heat sink 230. The support legs 324 align with the lower surface 314 of the heat sink 230 to provide three points of contact between the heat sink and the mounting surface. If the mounting surface is heat conductive, heat can pass into the mounting surface. Nevertheless, the heat sink is designed to dissipate the thermal energy produced by the LED without having to transfer heat to the mounting surface.

The LED module 214 has a low profile to facilitate spooling of the light engine 210. The light engine 210 can be packaged and shipped by winding the flexible light engine around a reel. The height of the LED module 214, i.e. the distance between the lower surface 314 of the heat sink (or the lower surface of the tape 450) and the uppermost portion of the truncated bowl-shaped portion 338 of the heat sink 272 is only slightly larger than the height (in the bending plane) of the power conductor 212. In the depicted embodiment, the height of the LED module is less 1.2 times the height of the power conductor 212. Also, the partial bowl-shaped portion 338 extends above the LED lens to protect the lens during handling, reeling and unreeling.

The LED light engine has been described with reference to certain embodiments. Obviously, modifications and alterations will occur to others upon reading and understanding the preceding detailed description. It is intended that the invention can be construed as including all such modifications and alterations in so far as they come within the scope of the appended claims or the equivalents thereof.

The invention claimed is:

1. A light engine comprising:

a flexible cord comprising an electrical wire and an insulating material for the wire;

a heat sink;

a PCB in contact the heat sink, the PCB including a first surface having circuitry and a second surface opposite the first surface, the circuitry being in electrical communication with the cord, wherein the second surface of the PCB is in thermal communication with the heat sink;

an LED mounted to the first surface of the PCB and in electrical communication with the circuitry; and a thermally conductive material contacting at least a portion of the first surface of the PCB and at least a portion of the heat sink for providing a thermal path from the first surface of the PCB into the heat sink.

2. The light engine of claim 1, wherein the thermally conductive material comprises a potting material.

3. The light engine of claim 1, wherein the PCB includes a thermally conductive material.

4. The light engine of claim 3, wherein the PCB is an MCPCB.

5. The light engine of claim 1, further comprising additional thermally conductive material interposed between the second surface of the PCB and the heat sink.

6. The light engine of claim 5, wherein the additional thermally conductive material is thermally conductive tape.

7. The light engine of claim 1, wherein the cord includes wires for delivering power to the LED and wires for delivering signals to the LED.

8. A light engine comprising:

a PCB including an upper surface, a lower surface and circuitry disposed on the upper surface;

an LED disposed on the upper surface of the PCB and in electrical communication with the circuitry;

a flexible cord comprising at least two wires and an insulating material for the wires, the at least two wires being in electrical communication with the circuitry, the cord being configured communicate with an associated power source and an associated signal generator, at least one of the wires being configured to deliver voltage to the LED to illuminate the LED and at least one of the wires being configured to deliver an electronic signal to the LED;

a heat sink including an upper portion defining a generally planar lower surface and a second portion disposed underneath the upper portion and defining a generally planar upper surface, the generally planar lower surface being disposed adjacent the upper surface of the PCB and the generally planar upper surface being disposed adjacent the lower surface of the PCB;

a thermally conductive material contacting at least a portion of the upper surface of the PCB and at least a portion of the generally planar lower surface of the upper portion of the heat sink for providing a thermal path from the upper surface of the PCB into the heat sink; and additional thermally conductive material contacting at least a portion of the lower surface of the PCB and at least a portion of the generally planar upper surface of the second portion of the heat sink for providing a thermal path from the lower surface of the PCB into the heat sink.

9. The light engine of claim 8, wherein at least one of the thermally conductive materials is a thermally conductive tape.

10. The light engine of claim 8, wherein the PCB is an MCPCB.

11. The light engine of claim 8, wherein the heat sink includes a side wall interconnecting the upper portion and the second portion and the generally planar upper surface of the second portion extends from the side wall in a plane and generally does not deviate from the plane.

* * * * *